US007645186B1

(12) United States Patent
Jensen et al.

(10) Patent No.: US 7,645,186 B1
(45) Date of Patent: Jan. 12, 2010

(54) CHEMICAL MECHANICAL POLISHING PAD MANUFACTURING ASSEMBLY

(75) Inventors: Michelle Jensen, Newark, DE (US); John Gifford Nowland, Elkton, MD (US); Brenda Harding, Newark, DE (US); Carol Corder, Elk Mills, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 12/175,965

(22) Filed: Jul. 18, 2008

(51) Int. Cl.
*B24D 11/00* (2006.01)

(52) U.S. Cl. ..... 451/534; 51/297; 156/289; 428/354; 451/538; 451/539; 451/550

(58) Field of Classification Search ..... 51/297, 51/298, 307; 428/343, 354, 41.7, 41.8; 451/490, 451/533, 534, 538, 539, 550; 156/289
See application file for complete search history.

(56) References Cited

U.S. PATENT DOCUMENTS

| | | | | |
|---|---|---|---|---|
| 4,728,552 | A | 3/1988 | Jensen, Jr. | |
| 5,257,478 | A | 11/1993 | Hyde et al. | |
| 5,507,906 | A | 4/1996 | Woods et al. | |
| 6,224,474 | B1 * | 5/2001 | Vander Voort | 451/494 |
| 6,699,104 | B1 | 3/2004 | Baker, III et al. | |
| 6,884,156 | B2 | 4/2005 | Prasad et al. | |
| 7,077,733 | B1 * | 7/2006 | Taylor | 451/303 |
| 7,101,275 | B2 | 9/2006 | Roberts et al. | |
| 7,361,078 | B2 * | 4/2008 | Taylor | 451/340 |
| 7,377,018 | B2 * | 5/2008 | Taylor | 29/402.01 |
| 7,549,914 | B2 * | 6/2009 | Ladjias | 451/533 |
| 2006/0135051 | A1 * | 6/2006 | Meyer et al. | 451/538 |

OTHER PUBLICATIONS

Copending U.S. Appl. No. 12/175,992.

* cited by examiner

*Primary Examiner*—Timothy V Eley
(74) *Attorney, Agent, or Firm*—Thomas S. Deibert

(57) ABSTRACT

A chemical mechanical polishing pad manufacturing assembly is provided having a subpad layer having a top surface and a bottom surface; a backing plate having a top side and a bottom side; a sacrificial layer having at least two recessed areas designed to facilitate attachment of a subpad layer to the backing plate; wherein the subpad layer is disposed on the top side of the backing plate and the sacrificial layer is disposed on the bottom side of the backing plate, and wherein the at least two wrap around tabs extend to the bottom side of the backing plate. Also provide is a method of manufacturing a chemical mechanical polishing pad using the chemical mechanical polishing pad manufacturing assembly.

9 Claims, 8 Drawing Sheets

CHEMICAL MECHANICAL POLISHING PAD MANUFACTURING ASSEMBLY

The present invention relates generally to the field of chemical mechanical polishing. In particular, the present invention is directed to a chemical mechanical polishing pad manufacturing assembly useful in the manufacture of chemical mechanical polishing pads.

In the fabrication of integrated circuits and other electronic devices, multiple layers of conducting; semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular shaped polishing track, or polishing region, wherein the wafer's surface directly confronts the polishing layer. The wafer surface is polished and made planar by chemical and mechanical action of the polishing layer and polishing medium on the surface.

Rutherford et al., in U.S. Pat. No. 6,007,407, disclose multilayer, chemical mechanical polishing pads, wherein two layers of different materials are laminated together. The typical two-layer polishing pad includes an upper polishing layer formed of a material, such as, polyurethane suitable for polishing the surface of a substrate. The upper polishing layer is attached to a lower layer or "subpad" formed from a material suitable for supporting the polishing layer. Conventionally, the two layers are bonded together using a pressure sensitive adhesive. In some polishing applications, however, multilayer chemical mechanical polishing pads laminated together using pressure sensitive adhesives have a tendency to delaminate during polishing, rendering the polishing pad useless and impeding the polishing process.

One approach to alleviating the delamination problem is disclosed in U.S. Pat. No. 7,101,275 to Roberts et al. Roberts et al. disclose resilient laminated polishing pads for chemical mechanical polishing, which pads include a base layer bonded to a polishing layer by a reactive hot melt adhesive rather than a pressure sensitive adhesive.

Notwithstanding, there is a continuing need for resilient multilayer laminated chemical mechanical polishing pads that resist internal breakdown (i.e., delamination) during use and for an improved chemical mechanical polishing pad assembly useful in the manufacture of such resilient multilayer laminated chemical mechanical polishing pads.

In one aspect of the present invention, there is provided a chemical mechanical polishing pad manufacturing assembly comprising: a subpad layer having a top surface, a bottom surface and at least two wrap around tabs; a backing plate having a top side and a bottom side; a sacrificial layer having at least two recessed areas designed to facilitate attachment of the subpad layer to the backing plate; wherein the subpad layer is disposed on the top side of the backing plate and the sacrificial layer is disposed on the bottom side of the backing plate, and wherein the at least two wrap around tabs extend to the bottom side of the backing plate.

In another aspect of the present invention, there is provided a chemical mechanical polishing pad manufacturing assembly comprising: a subpad layer having a top surface, a bottom surface, and at least two wrap around tabs, wherein the at least two wrap around tabs are perforated to facilitate removal of the at least two wrap around tabs from the subpad layer; a backing plate having a top side and a bottom side; a sacrificial layer having at least two recessed areas designed to facilitate attachment of the subpad layer to the backing plate; an unset reactive hot melt adhesive applied to the top surface of the subpad layer, wherein the unset reactive hot melt adhesive is applied in a pattern of parallel lines; a first pressure sensitive adhesive applied to the bottom surface of the subpad layer; a release liner, wherein the first pressure sensitive adhesive is interposed between the bottom surface of the subpad layer and the release liner, and wherein the release liner is absent from the at least two wrap around tabs exposing the first pressure sensitive adhesive applied to the at least two wrap around tabs to the backing plate; and, a second pressure sensitive adhesive interposed between the sacrificial layer and the bottom side of the backing plate, wherein the second pressure sensitive adhesive is compositionally the same or different from the first pressure sensitive adhesive; wherein the subpad layer is disposed on the top side of the backing plate; wherein the at least two wrap around tabs extend to the bottom side of the backing plate; wherein the first pressure sensitive adhesive applied to the at least two perforated wrap around tabs and exposed to the backing plate secures the at least two wrap around tabs to the backing plate; and, wherein the second pressure sensitive adhesive secures the sacrificial layer to the backing plate.

In another aspect of the present invention, there is provided a method of manufacturing a chemical mechanical polishing pad, comprising: providing a polishing layer; providing a chemical mechanical polishing pad manufacturing assembly, comprising: a subpad layer having a top surface, a bottom surface and at least two wrap around tabs; and backing plate having a top side and a bottom side; a sacrificial layer having at least two recessed areas designed to facilitate attachment of the subpad layer to the backing plate; an unset reactive hot melt adhesive applied to the top surface of the subpad layer in a pattern of parallel lines; wherein the subpad layer is disposed on the top side of the backing plate and the sacrificial layer is disposed on the bottom side of the backing plate, and wherein the at least two wrap around tabs extend to the bottom side of the backing plate; stacking the polishing layer and the chemical mechanical polishing pad manufacturing assembly with the unset reactive hot melt adhesive interposed between the polishing layer and the subpad layer; applying an axial force to the stack; allowing the unset reactive hot melt adhesive to set forming a reactive hot melt adhesive bond between the subpad layer and the polishing layer; separating the at least two wrap around tabs from the subpad layer; and, removing the subpad layer with the polishing layer attached thereto from the chemical mechanical polishing pad manufacturing assembly to provide a multilayer chemical mechanical polishing pad.

DETAILED DESCRIPTION

Figure 1A:
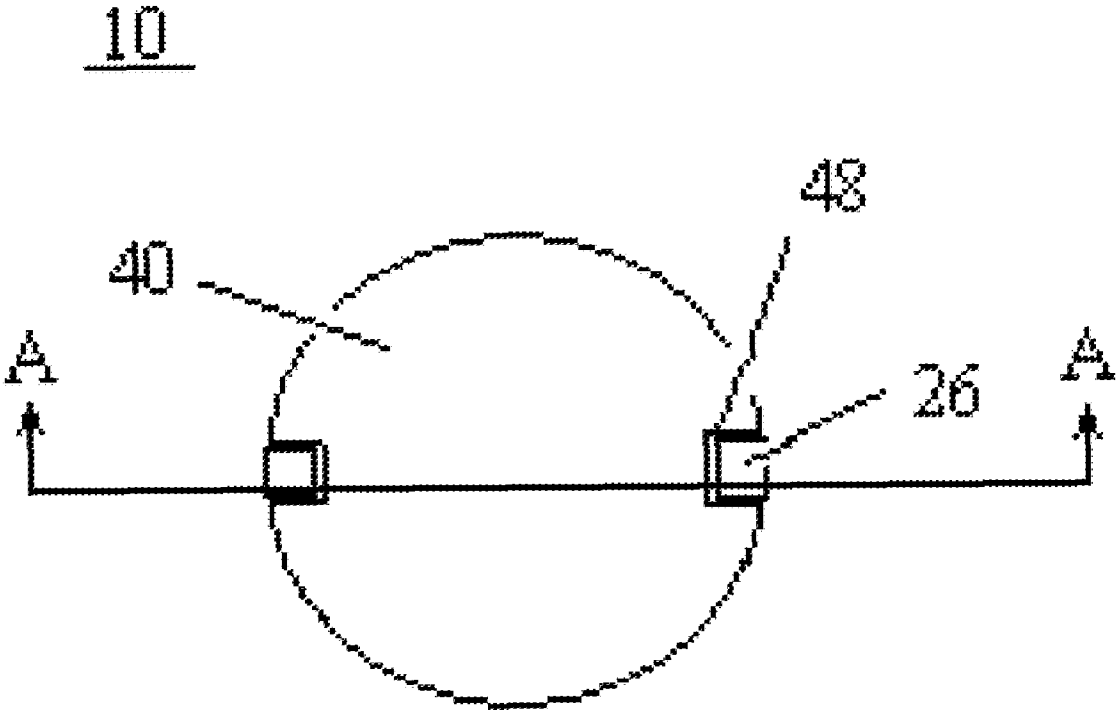
FIG. 1A is a bottom plan view of a chemical mechanical polishing pad manufacturing assembly of the present invention.

The term "substantially circular cross section" as used herein and in the appended claims in reference to a chemical mechanical polishing pad manufacturing assembly or component thereof means that the longest radius, r, of a cross section from a central axis to an outer periphery of the chemical mechanical polishing pad manufacturing assembly or component thereof is ≦20% longer than the shortest radius, r, of the cross section from the central axis to the outer periphery. (See FIG. 6).

In some embodiments of the present invention, there is provided a chemical mechanical polishing pad manufacturing assembly, wherein the chemical mechanical polishing pad manufacturing assembly exhibits a substantially circular cross section.

In some embodiments of the present invention, there is provided a chemical mechanical polishing pad manufacturing assembly, comprising a pressure sensitive adhesive interposed between the at least two wrap around tabs and the bottom side of the backing plate, wherein the pressure sensitive adhesive secures the at least two wrap around tabs to the backing plate. In some aspects of these embodiments, the subpad layer is perforated to facilitate removal of the at least two wrap around tabs.

In some embodiments of the present invention, there is provided a chemical mechanical polishing pad manufacturing assembly comprising: a subpad layer having a top surface, a bottom surface and at least two wrap around tabs; a backing plate having a top side and a bottom side; a pressure sensitive adhesive applied to the bottom surface of the subpad layer; a release liner applied over the pressure sensitive adhesive such that the pressure sensitive adhesive is interposed between the bottom surface of the subpad layer and the release liner; a sacrificial layer having at least two recessed areas designed to facilitate attachment of the subpad layer to the backing plate; wherein the subpad layer is disposed on the top side of the backing plate and the sacrificial layer is disposed on the bottom side of the backing plate, and wherein the at least two wrap around tabs extend to the bottom side of the backing plate. In some aspects of these embodiments, the release liner is removed or is absent from the at least two wrap around tabs. In some aspects of these embodiments, the pressure sensitive adhesive applied to the at least two wrap around tabs makes adhesive contact with the at least two wrap around tabs and the bottom side of the backing plate. In some aspects of these embodiments, the pressure sensitive adhesive secures the at least two wrap around tabs to the bottom side of the backing plate and thereby holds the subpad layer to the backing plate. In some aspects of these embodiments, the subpad layer is perforated to facilitate removal of the at least two wrap around tabs.

In some embodiments of the present invention, the subpad layer further comprises at least one opening. In some aspects of these embodiments, the at least one opening facilitates the manufacture of a chemical mechanical polishing pad having a window to enable in situ monitoring of a chemical mechanical polishing operation. In some aspects of these embodiments, the at least one opening has a cross section selected from a circular cross section, an elliptical cross section and a squoval cross section. In some aspects of these embodiments, the at least one opening has a circular cross section. In some aspects of these embodiments, the at least one opening has an elliptical cross section. In some aspects of these embodiments, the at least one opening has a squoval cross section.

In some embodiments of the present invention, the subpad layer comprises any material suitable for use in a chemical mechanical polishing pad. In some aspects of these embodiments, the subpad layer comprises an elastic polymeric material. In some aspects of these embodiments, the subpad layer comprises a material selected from a polyurethane impregnated felt and a polyurethane foam. In some aspects of these embodiments, the subpad layer is a polyurethane impregnated felt. In some aspects of these embodiments, the subpad layer is a polyurethane foam. In some aspects of these embodiments, the subpad layer is a buffed high density urethane foam. In some aspects of these embodiments, the subpad layer is a closed cell polyurethane foam.

One of ordinary skill in the art would understand to select a subpad layer having a thickness suitable to provide the desired mechanical properties to a given multilayer chemical mechanical polishing pad for use in a given polishing operation. In some embodiments of the present invention, the subpad layer has a thickness of 0.75 to 2.5 mm; preferably 0.75 to 2.0 mm.

In some embodiments of the present invention, there is provided a chemical mechanical polishing pad manufacturing assembly comprising: a subpad layer having a top surface, a bottom surface and at least two wrap around tabs; an unset reactive hot melt adhesive applied to the top surface of the subpad layer; a backing plate having a top side and a bottom side; a sacrificial layer having at least two recessed areas designed to facilitate attachment of the subpad layer to the backing plate; wherein the subpad layer is disposed on the top side of the backing plate and the sacrificial layer is disposed on the bottom side of the backing plate; wherein the at least two wrap around tabs extend to the bottom side of the backing plate; and, wherein the unset reactive hot melt adhesive is applied in a pattern of parallel lines. In some aspects of these embodiments, the subpad layer is perforated to facilitate removal of the at least two wrap around tabs. In some aspects of these embodiments, the unset reactive hot melt adhesive is applied to the top surface of the subpad layer at a coat weight of 6,500 to 13,940 g/cm$^2$, preferably 8,350 to 12,100 g/cm$^2$. In some aspects of these embodiments, the pattern of parallel lines contains a plurality of individual lines, wherein the individual lines are parallel to one another. In some aspects of these embodiments, the individual lines exhibit a thickness of 0.05 to 0.20 mm, preferably 0.0762 to 0.172 mm; a width of 1.5 to 3.25 mm, preferably 1.58 to 3.18 mm; and a spacing between individual lines in the pattern of parallel lines of 1.5 to 3.25 mm, preferably 1.58 to 3.18 mm. In some aspects of these embodiments, there are valleys between the individual lines that are devoid of unset reactive hot melt adhesive. In some aspects of these embodiments, there are valleys between the individual lines that are not devoid of unset reactive hot melt adhesive, wherein the thickness of the unset reactive hot melt adhesive measured at the center of the valleys is ≦5% of the thickness of the unset reactive hot melt adhesive measured at the center of the individual lines. In some aspects of these embodiments, the unset reactive hot melt adhesive exhibits a melting temperature of 50 to 150° C., preferably of 115 to 135° C. and a pot life of ≦90 minutes after melting. In some aspects of these embodiments, the unset reactive hot melt adhesive in its uncured state comprises a polyurethane resin (e.g., Mor-Melt™ R5003 available from Rohm and Haas).

In one aspect of the present invention, there is provided a chemical mechanical polishing pad manufacturing assembly comprising: a subpad layer having a top surface, a bottom surface and at least two wrap around tabs; a backing plate having a top side and a bottom side; a sacrificial layer having at least two recessed areas designed to facilitate attachment of the subpad layer to the backing plate; and a layer of pressure sensitive adhesive interposed between the sacrificial layer and the bottom side of the backing plate; wherein the subpad layer is disposed on the top side of the backing plate; wherein the layer of pressure sensitive adhesive secures the sacrificial layer to the bottom side of the backing plate and wherein the at least two wrap around tabs extend to the bottom side of the backing plate. In some aspects of these embodiments, the subpad layer is perforated to facilitate removal of the at least two wrap around tabs.

In one aspect of the present invention, there is provided a chemical mechanical polishing pad manufacturing assembly comprising: a subpad layer having a top surface, a bottom surface and at least two wrap around tabs; a backing plate having a top side and a bottom side; a sacrificial layer having at least two recessed areas designed to facilitate attachment of the subpad layer to the backing plate; wherein the subpad layer is disposed on the top side of the backing plate and the sacrificial layer is disposed on the bottom side of the backing plate; wherein the at least two wrap around tabs extend to the bottom side of the backing plate and wherein the at least two wrap around tabs engage the at least two recessed areas of the sacrificial layer. In some aspects of these embodiments, the at least two wrap around tabs do not make physical contact with the sacrificial layer. In some aspects of these embodiments, the at least two wrap around tabs interlock with the at least two recessed areas of the sacrificial layer. In some aspects of these embodiments, the interlocking engagement of the at least two wrap around tabs with the at least two recessed areas of the sacrificial layer secures the subpad layer to the backing plate. In some aspects of these embodiments, the subpad layer is perforated to facilitate removal of the at least two wrap around tabs.

In practicing the invention, given the teachings provided herein, one or ordinary skill in the art would understand to select a backing plate having a suitable thickness and material of construction. In some embodiments of the present invention, the backing plate has a thickness of 2.54 to 5.1 mm. In some aspects of these embodiments, the backing plate is constructed of a material selected from aluminum and acrylic sheet.

In some embodiments of the present invention, the backing plate has a substantially circular cross section. One of ordinary skill in the art will understand that the diameter of the backing plate is limited by the size of the coater used to apply the unset reactive hot melt adhesive. In some aspects of these embodiments, the backing plate exhibits a diameter of 600 to 1,600 mm; preferably 600 to 1,200 mm.

In some embodiments of the present invention, there is provided a chemical mechanical polishing pad manufacturing assembly comprising: a subpad layer having a top surface, a bottom surface and at least two wrap around tabs; a backing plate having a top side and a bottom side; a sacrificial layer having at least two recessed areas designed to facilitate attachment of the subpad layer to the backing plate; an unset reactive hot melt adhesive applied to the top surface of the subpad layer in a pattern of parallel lines; a first pressure sensitive adhesive applied to the bottom surface of the subpad layer; a release liner, wherein the first pressure sensitive adhesive is interposed between the bottom surface of the subpad layer and the release liner, and wherein the release liner is absent from the at least two wrap around tabs exposing the first pressure sensitive adhesive applied to the at least two wrap around tabs to the backing plate; and, a second pressure sensitive adhesive interposed between the sacrificial layer and the bottom side of the backing plate, wherein the second pressure sensitive adhesive is compositionally the same or different from the first pressure sensitive adhesive; wherein the subpad layer is disposed on the top side of the backing plate; wherein the at least two wrap around tabs extend to the bottom side of the backing plate; wherein the first pressure sensitive adhesive applied to the at least two wrap around tabs and exposed to the backing plate secures the at least two wrap around tabs to the bottom side of the backing plate; and, wherein the second pressure sensitive adhesive secures the sacrificial layer to the bottom side of the backing plate. In some aspects of these embodiments, the subpad layer is perforated to facilitate removal of the at least two wrap around tabs.

The present invention will now be described in further detail herein in reference to the Figures. The chemical mechanical polishing pad manufacturing assembly as described and shown in the Figures has a substantially circular cross section. Notwithstanding, given the teachings provided herein, one of ordinary skill in the art would understand how to employ other geometric cross sections such as, for example, polygonal, annular, oval and amorphous.

In FIG. 1A there is provided a bottom plan view of a chemical mechanical polishing pad manufacturing assembly of the present invention. In particular, FIG. 1A provides a view of a sacrificial layer 40 with recessed portions 48. FIG. 1A also provides a view of a wrap around tabs 26 of a subpad layer 20 engaged with recessed areas 48 of the sacrificial layer 40.

Figure 1B:
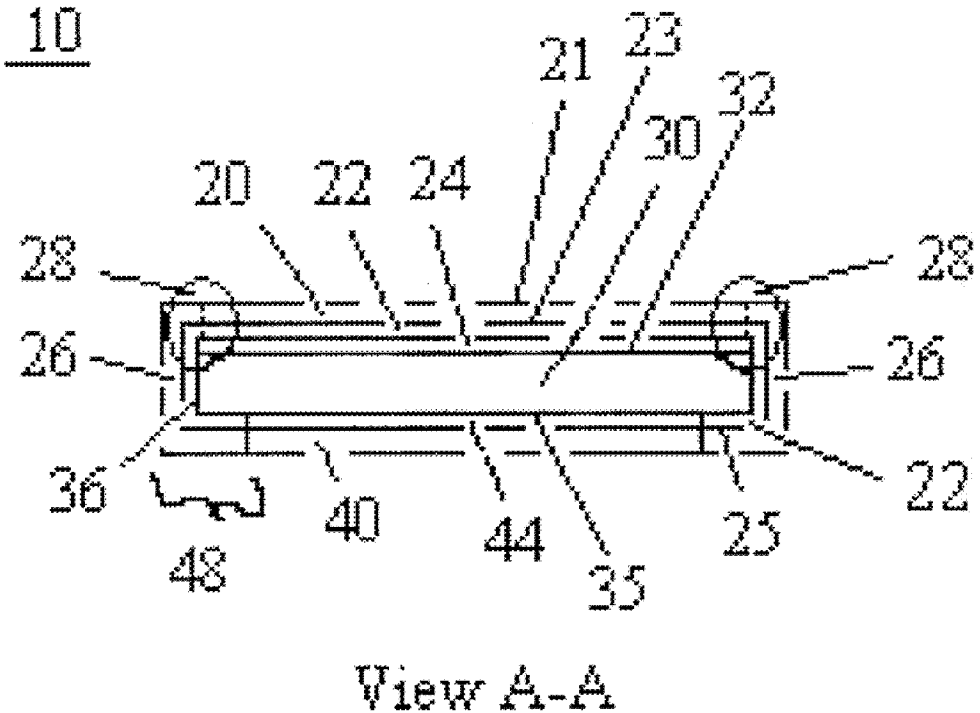
FIG. 1B is an elevation cut away view A-A of the chemical mechanical polishing pad manufacturing assembly of FIG. 1A.

In FIG. 1B there is provided a side elevational cut away view A-A of the chemical mechanical polishing pad manufacturing assembly of FIG. 1A. In particular, FIG. 1B provides a view of subpad layer 20 having a top surface 21 and a bottom surface 23 with wrap around tabs 26 having perforations 28, which perforations 28 facilitate removal of the wrap around tabs 26 from the subpad layer 20. A first pressure sensitive adhesive 22 is applied to a bottom surface 23 of the subpad layer 20. The first pressure sensitive adhesive 22 is interposed between the bottom surface 23 of the subpad layer 20 and a release liner 24, which is interposed between the first pressure sensitive adhesive 22 and a top side 32 of the backing plate 30. A sacrificial layer 40 is adhered to the bottom side 35 of the backing plate 30 with a second pressure sensitive adhesive layer 44. The sacrificial layer 40 has recessed areas 48. The release liner 24 is absent from the first pressure sensitive adhesive 22 applied to a bottom surface 25 of the wrap around tabs 26, such that the first pressure sensitive adhesive 22 makes adhesive contact between the wrap around tabs 26 and a bottom side 35 of backing plate 30. The wrap around tabs 26 extend around the outer periphery 36 of backing plate 30 and engage the recessed areas 48 in the sacrificial layer 40.

Figure 2:
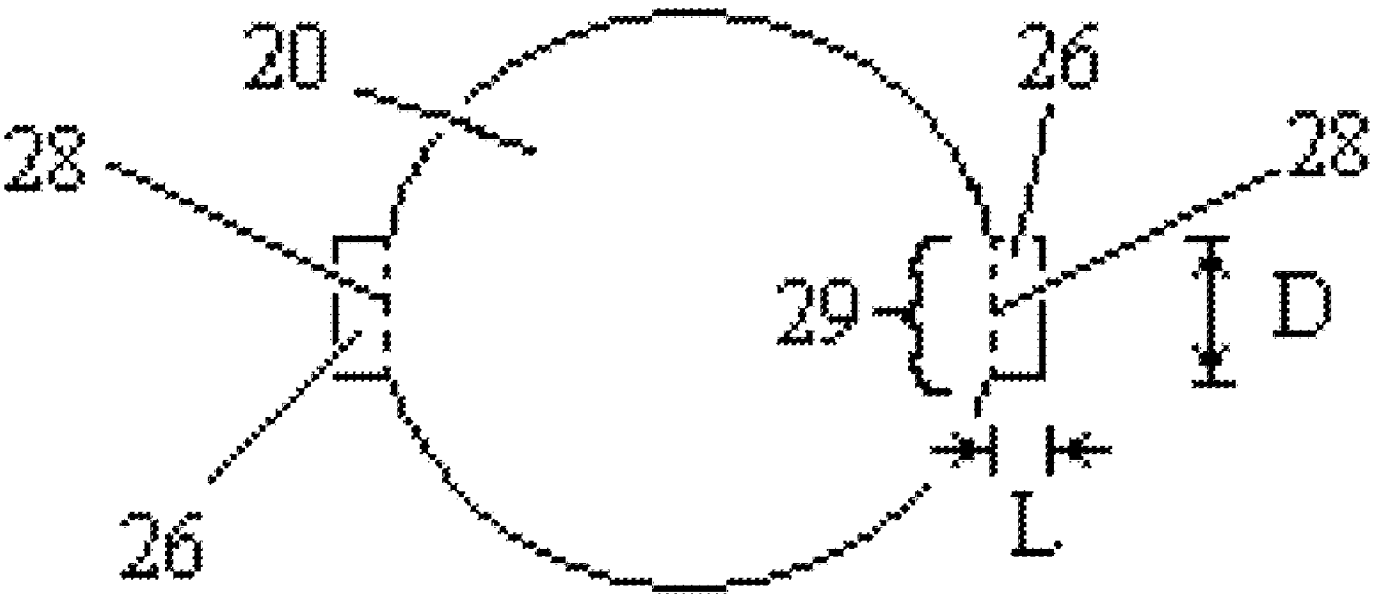
FIG. 2 is a top plan view of a subpad layer designed to be incorporated into a chemical mechanical polishing pad manufacturing assembly as depicted in FIGS. 1A and 1B.

In FIG. 2 there is provided a top plan view of the subpad layer 20 of the chemical mechanical polishing pad manufacturing assembly shown in FIGS. 1A and 1B. In particular, FIG. 2 shows a top plan view of the subpad layer 20 with perforations 28 and wrap around tabs 26. In some embodiments of the present invention, the wrap around tabs 26 of the subpad layer 20 extend a length, L, 10 to 50 mm from the perforation 28 of the subpad layer and extend a distance, D, 50 to 200 mm, preferably 50 to 100 mm, along the perforation 29 of the subpad layer.

Figure 3:
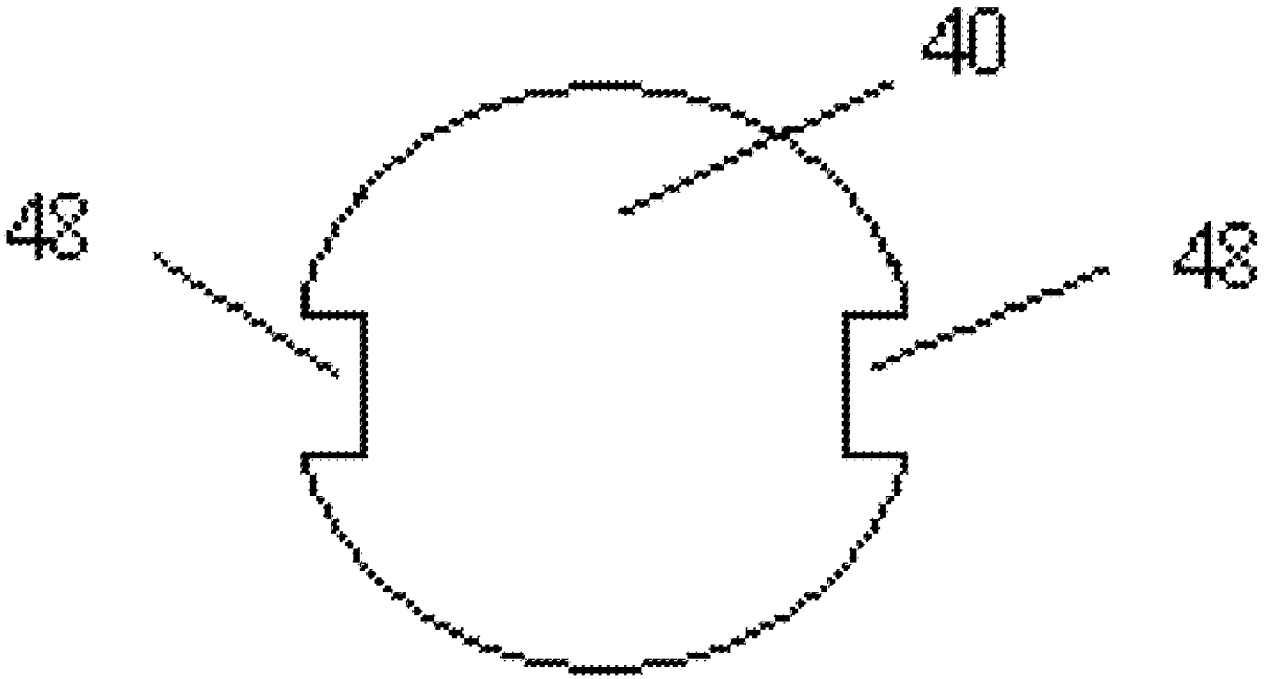
FIG. 3 is a top plan view of a sacrificial layer designed to be incorporated into a chemical mechanical polishing pad manufacturing assembly as depicted in FIGS. 1A and 1B.

In FIG. 3 there is provided a top plan view of the sacrificial layer 40 of the chemical mechanical polishing pad manufacturing assembly shown in FIGS. 1A and 1B. In particular, FIG. 3 shows a top plan view of the sacrificial layer 40 with recessed portions 48 designed to engage with the wrap around tabs 28 of the subpad layer 20 as shown in FIG. 2.

Figure 4:
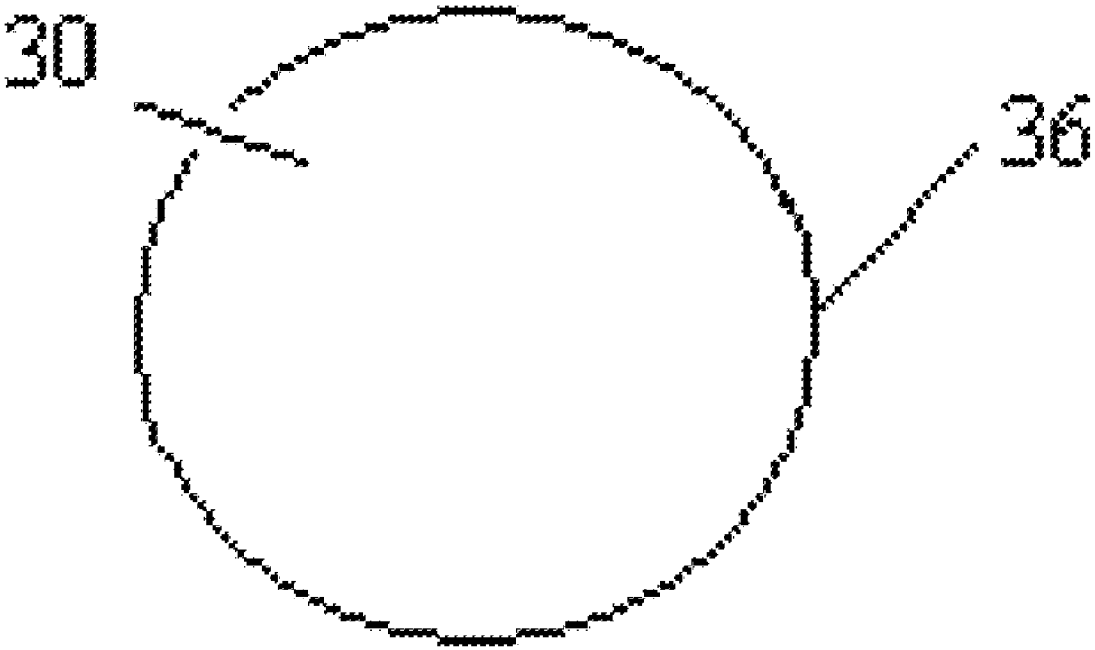
FIG. 4 is a top plan view of a backing plate designed to be incorporated into a chemical mechanical polishing pad manufacturing assembly as depicted in FIGS. 1A and 1B.

In FIG. 4 there is provided a top plan view of the backing plate 30 of the chemical mechanical polishing pad manufacturing assembly shown in FIGS. 1A and 1B. In particular, FIG. 4 shows a top plan view of the backing plate 30 having an outer periphery 36, wherein the backing plate has a substantially circular cross section.

Figure 5A:
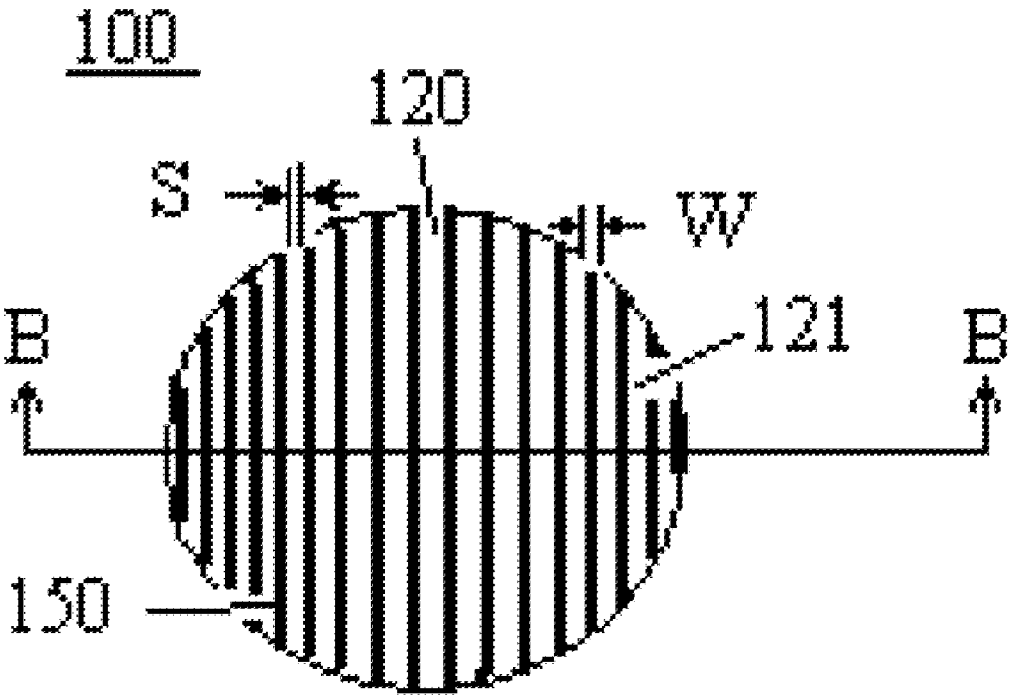
FIG. 5A is a top plan view of a chemical mechanical polishing pad manufacturing assembly having with an unset reactive hot melt adhesive applied to the top surface of the subpad layer.

In FIG. 5A there is provided a top plan view of a chemical mechanical polishing pad manufacturing assembly having an unset reactive hot melt adhesive applied to a top surface 121 of a subpad layer 120. In particular, FIG. 5A provides a view of a subpad layer 120 and a pattern of individual parallel lines of unset reactive hot melt adhesive 150 applied to a top surface 121 of the subpad layer 120. The individual parallel lines of unset reactive hot melt adhesive in the pattern 150 have a width W and a separation S between adjacent lines.

Figure 5B:
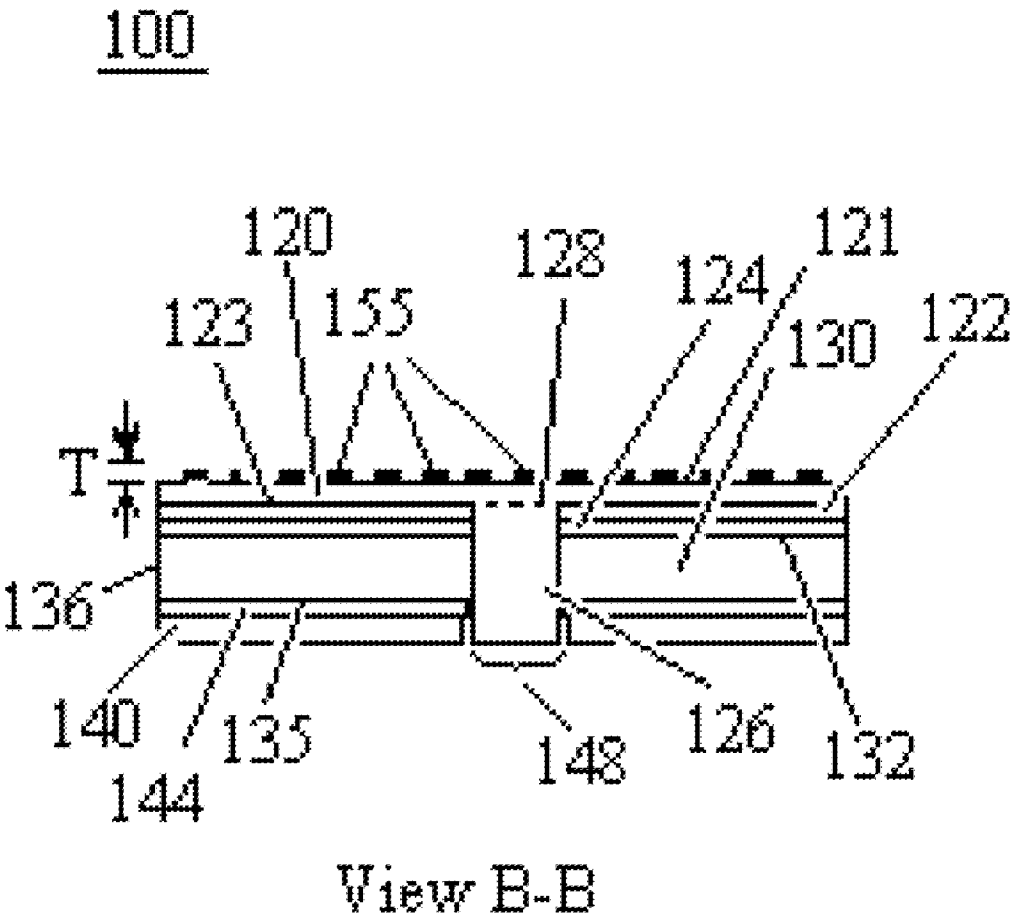
FIG. 5B is an elevational view of a cut away view B-B of the chemical mechanical polishing pad manufacturing assembly of FIG. 5A.

In FIG. 5B there is provided a side elevation cut away view B-B of the chemical mechanical polishing pad manufacturing assembly depicted in FIG. 5A. In particular, FIG. 5B provides a view of subpad layer 120 having a top surface 121 and a bottom surface 123 with wrap around tabs 126 having perforations 128, which perforations 128 facilitate the subsequent removal of the wrap around tabs 126 from the subpad layer 120. A first pressure sensitive adhesive 122 is applied to a bottom surface 123 of the subpad layer 120. The first pressure sensitive adhesive 122 is interposed between the bottom surface 123 of the subpad layer 120 and a release liner 124, which is interposed between the first pressure sensitive adhesive 122 and a top side 132 of the backing plate 130. A sacrificial layer 140 is adhered to the bottom side 135 of the backing plate 130 with a second pressure sensitive adhesive 144. The sacrificial layer 140 has recessed areas 148. The release liner 124 is absent from the first pressure sensitive adhesive 122 applied to a bottom surface 125 of the wrap around tabs 126, such that the first pressure sensitive adhesive 122 makes adhesive contact between the wrap around tabs 126 and a bottom side 135 of backing plate 130. The perforated wrap around tabs 126 extend around an outer periphery 136 of backing plate 130 and engage the recessed areas 148 in the sacrificial layer 140. In the particular embodiment of the present invention depicted in FIG. 5B, the chemical mechanical polishing pad manufacturing assembly has a pattern of individual parallel lines of unset reactive hot melt adhesive 155 applied to a top surface 121 of the subpad layer 120. The individual parallel lines of unset reactive hot melt adhesive in the pattern 155 have a thickness T.

Figure 6:
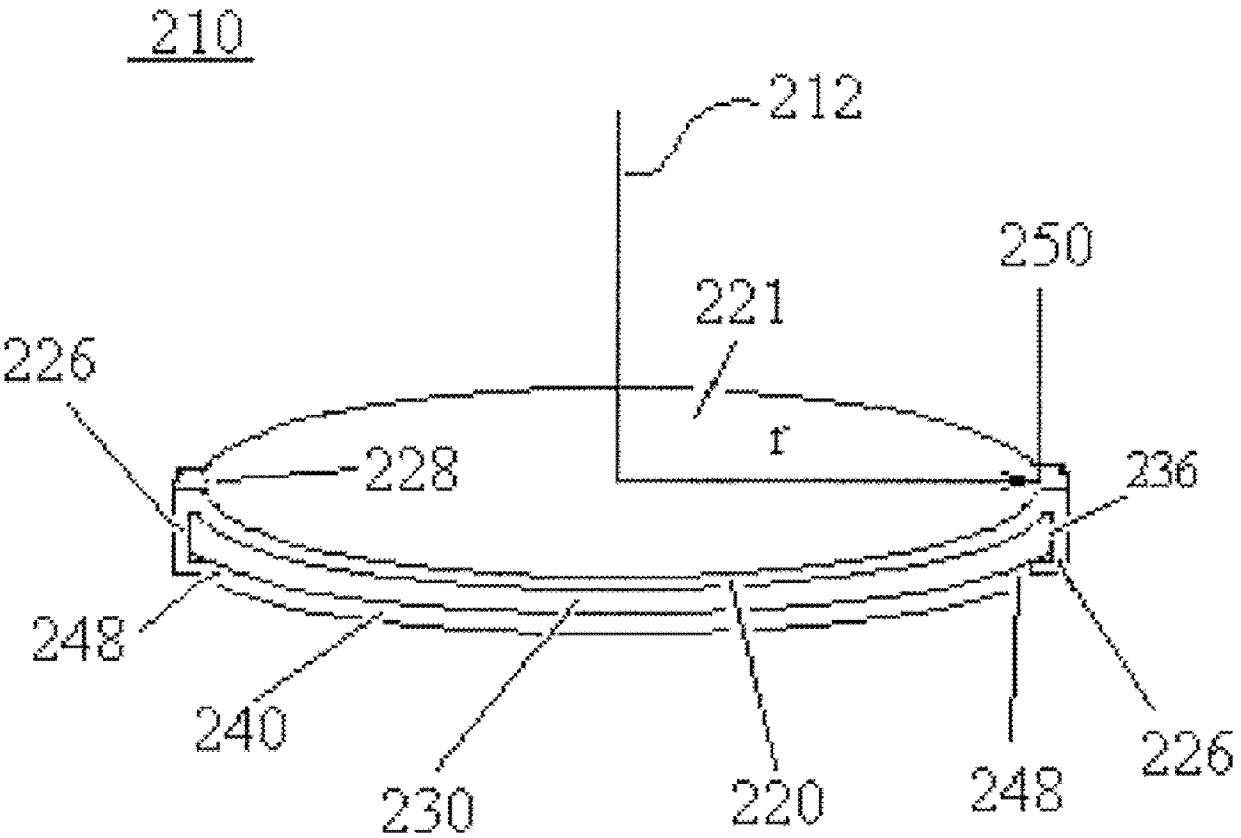
FIG. 6 is a perspective top/side view of a chemical mechanical polishing pad manufacturing assembly of the present invention.

In FIG. 6 there is provided a top/side perspective view of a chemical mechanical polishing pad manufacturing assembly in accordance with some embodiments of the present invention. In particular, FIG. 6 provides a view of the top surface 221 of a subpad layer 220 of the chemical mechanical polishing pad manufacturing assembly 210 that is in a plane substantially perpendicular to a central axis 212 of the chemical mechanical polishing pad manufacturing assembly. In some aspects of these embodiments, the chemical mechanical polishing pad manufacturing assembly has a substantially circular cross section perpendicular to the central axis 212. In some aspects of these embodiments, the longest radius, r, from the central axis 212 to an outer periphery 250 of a cross section of the chemical mechanical polishing pad manufacturing assembly 210 in a plane that is perpendicular to the central axis 212, is $\leqq$20%, preferably $\leqq$10% longer than the shortest radius, r. In some aspects of these embodiments, the radius, r, of the cross section is 300 to 600 mm. In some aspects of these embodiments, the wrap around tabs 226 of the subpad layer 220 extend from the perforation 228 of the subpad layer and wrap around an outer periphery 236 of the backing plate 230 and engage recessed portions 248 of sacrificial layer 240.

The chemical mechanical polishing pad manufacturing assembly of the present invention is useful in the manufacture of multilayer chemical mechanical polishing pads comprising a polishing layer, optionally one or more intermediate layers and a subpad layer.

In some embodiments of the present invention, the chemical mechanical polishing pad manufacturing assembly is incorporated into multilayer chemical mechanical polishing pads comprising a polishing layer made from a polymeric material comprising a polymer selected from polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, EPDM, and combinations thereof. In some aspects of these embodiments, the polishing layer comprises a polyurethane.

One of ordinary skill in the art will understands to select a polishing layer having a thickness suitable for use in a given multilayer chemical mechanical polishing pad for a given polishing operation. In some embodiments of the present invention, the chemical mechanical polishing pad manufacturing assembly is incorporated into multilayer chemical mechanical polishing pads comprising a polishing layer exhibiting an average thickness of 20 to 150 mils. In some aspects of these embodiments, the polishing layer has an average thickness of 30 to 125 mils. In some aspects of these embodiments, the polishing layer has an average thickness of 40 to 120 mils.

In some embodiments of the present invention, there is provided a method of manufacturing a multilayer chemical mechanical polishing pad, comprising: providing a polishing layer; providing a chemical mechanical polishing pad manufacturing assembly, comprising: a subpad layer having a top surface, a bottom surface and at least two wrap around tabs; a backing plate having a top side and a bottom side; a sacrificial layer having at least two recessed areas designed to facilitate attachment of the subpad layer to the backing plate; an unset reactive hot melt adhesive applied to the top surface of the subpad layer in a pattern of parallel lines; wherein the subpad layer is disposed on the top side of the backing plate and the sacrificial layer is disposed on the bottom side of the backing plate, and wherein the at least two wrap around tabs extend to the bottom side of the backing plate; stacking the polishing layer and the chemical mechanical polishing pad manufacturing assembly with the unset reactive hot melt adhesive interposed between the polishing layer and the subpad layer forming a stack; applying an axial force to the stack; allowing the unset reactive hot melt adhesive to set forming a reactive hot melt adhesive bond between the subpad layer and the polishing layer; separating the at least two wrap around tabs from the subpad layer; and, removing the subpad layer with the polishing layer attached thereto from the chemical mechanical polishing pad manufacturing assembly providing a multilayer chemical mechanical polishing pad. In some aspects of these embodiments, the at least two wrap around tabs are cut from the subpad layer. In some aspects of these embodiments, a die is used to stamp/cut the stack to provide the multilayer chemical mechanical polishing pad comprising the subpad layer bonded to the polishing layer. In some aspects of these embodiments, the subpad layer is perforated to facilitate removal of the at least two wrap around tabs.

We claim:

1. A chemical mechanical polishing pad manufacturing assembly comprising:

a subpad layer having a top surface, a bottom surface and at least two wrap around tabs;

a backing plate having a top side and a bottom side; and, a sacrificial layer having at least two recessed areas designed to facilitate attachment of the subpad layer to the backing plate;

wherein the subpad layer is disposed on the top side of the backing plate and the sacrificial layer is disposed on the bottom side of the backing plate, and wherein the at least two wrap around tabs extend to the bottom side of the backing plate.

2. The chemical mechanical polishing pad manufacturing assembly of claim 1, further comprising:

an unset reactive hot melt adhesive applied to the top surface of the subpad layer;

wherein the unset reactive hot melt adhesive is applied in a pattern of parallel lines.

3. The chemical mechanical polishing pad manufacturing assembly of claim 1, wherein the subpad layer has perforations to facilitate removal of the at least two wrap around tabs.

4. The chemical mechanical polishing pad manufacturing assembly of claim 1, further comprising a pressure sensitive adhesive interposed between a bottom surface of the at least two wrap around tabs and the bottom side of the backing plate, wherein the pressure sensitive adhesive secures the at least two wrap around tabs to the bottom side of the backing plate.

5. The chemical mechanical polishing pad manufacturing assembly of claim 1, further comprising a pressure sensitive adhesive applied to the bottom surface of the subpad layer and a release liner, wherein the release liner is interposed between the pressure sensitive adhesive and the top side of the backing plate, and wherein the release liner is absent from the at least two wrap around tabs such that the pressure sensitive adhesive applied to the bottom surface of the subpad layer secures the at least two wrap around tabs to the bottom side of the baking plate.

6. The assembly of claim 1, further comprising a layer of pressure sensitive adhesive interposed between the sacrificial layer and the bottom side of the backing plate, wherein the pressure sensitive adhesive secures the sacrificial layer to the bottom side of the backing plate.

7. The assembly of claim 1, wherein the at least two wrap around tabs engage the at least two recessed areas of the sacrificial layer.

8. The assembly of claim 1, wherein the at least two wrap around tabs interlock with the at least two recessed areas of the sacrificial layer.

9. A chemical mechanical polishing pad manufacturing assembly comprising:

a subpad layer having a top surface, a bottom surface and at least two perforated wrap around tabs;

a backing plate having a top side and a bottom side;

a sacrificial layer having at least two recessed areas designed to facilitate attachment of the subpad layer to the backing plate;

an unset reactive hot melt adhesive applied to the top surface of the subpad layer in a pattern of parallel lines;

a first pressure sensitive adhesive applied to the bottom surface of the subpad layer;

a release liner, wherein the first pressure sensitive adhesive is interposed between the bottom surface of the subpad layer and the release liner, wherein the release liner is interposed between the first pressure sensitive adhesive and the top side of the backing plate and wherein the release liner is absent from the at least two perforated wrap around tabs exposing the first pressure sensitive adhesive to the bottom side of the backing plate; and, a second pressure sensitive adhesive interposed between the sacrificial layer and the bottom side of the backing plate, wherein the second pressure sensitive adhesive is compositionally the same or different from the first pressure sensitive adhesive;

wherein the subpad layer is disposed on the top side of the backing plate; wherein the at least two perforated wrap around tabs extend to the bottom side of the backing plate; wherein the first pressure sensitive adhesive exposed to the bottom side of the backing plate by way of the at least two perforated wrap around tabs secures the at least two perforated wrap around tabs to the bottom side of the backing plate; and, wherein the second pressure sensitive adhesive secures the sacrificial layer to the bottom side of the backing plate.

* * * * *